United States Patent [19]

Gallini et al.

[11] 4,056,240

[45] Nov. 1, 1977

[54] YARN GUIDE

[75] Inventors: John Battista Gallini; Gerald Dean Hauxwell; Christopher Roger Whitfield, all of Richmond, Va.

[73] Assignee: E. I. Du Pont de Nemours and Company, Wilmington, Del.

[21] Appl. No.: 770,060

[22] Filed: Feb. 18, 1977

[51] Int. Cl.[2] ..... B65H 57/16; B65H 57/04; D01H 13/04

[52] U.S. Cl. ..... 242/47.09; 57/106; 242/157 R

[58] Field of Search ..... 57/106; 242/47.01, 47.09, 242/157 R, 47.11

[56] References Cited

U.S. PATENT DOCUMENTS

| | | | |
|---|---|---|---|
| 2,675,601 | 4/1954 | Still | 28/180 |
| 2,801,455 | 8/1957 | McClellan | 57/2.3 |
| 2,892,336 | 6/1959 | Pensotti | 68/19 |
| 2,896,879 | 7/1959 | Vandenburgh | 242/157 R |
| 2,967,027 | 1/1961 | McFadden | 242/157 R |
| 3,475,896 | 11/1969 | Gibson et al. | 57/106 |
| 3,478,732 | 11/1969 | Clark et al. | 242/157 R X |
| 3,912,184 | 10/1975 | Bous | 242/47.01 |

FOREIGN PATENT DOCUMENTS

| | | | |
|---|---|---|---|
| 603,351 | 2/1958 | Italy | 242/47.09 |
| 594,384 | 11/1947 | United Kingdom | 242/47.11 |

*Primary Examiner*—Donald Watkins

[57] ABSTRACT

A yarn guide comprising a rotatably mounted circumferentially grooved cylindrical bar having as part of the bar surface a smoothly recessed, relatively flat area advancing helically less than a complete turn along the the length of the bar, the relatively flat area being uniformly recessed to a depth such that at least part of the recessed area is devoid of grooves. The guide permits step-wise engagement of a multiplicity of yarns.

4 Claims, 2 Drawing Figures

YARN GUIDE

BACKGROUND OF THE INVENTION

This invention relates to a yarn guide suitable for stabilizing multiple wraps of yarn passing over forwarding rolls.

Grooved guides of various types are known but in systems where multiple wraps of yarn on forwarding rolls need to be stabilized, the known grooved guides become progressively more difficult to engage as the number of yarn wraps increases. Yarn traveling over forwarding rolls tends to wander somewhat resulting in a certain amount of instability in the positioning of the yarn. This instability is cumulative so that in a multiple wrap system having a large number of wraps, the instability can be quite severe in the later wraps. The problem is particularly acute in the case of handling wet yarns which tend to stick together when they make contact, often resulting in broken fibers and/or fiber transfer between yarns.

SUMMARY OF THE INVENTION

The present invention provides a yarn guide comprising a rotatably mounted circumferentially grooved cylindrical bar having as part of the bar surface a smoothly recessed, relatively flat area advancing helically less than a complete turn along the length of the bar, the relatively flat area being uniformly recessed to a depth such that at least part of the recessed area is devoid of grooves. Preferably, the yarn guide is rotatably mounted between two canted rolls of approximately the same length as the guide, the guide being mounted with its axis parallel to the axis of the following roll and positioned so that yarn traveling over the rolls will contact the bottom of the grooves in the bar. Preferably the relatively flat area advances helically 250° to 290° along the bar. The invention is operable for 200 to 2250 denier yarn at 0.25 to 1.5 g/denier tension. For 1500 denier yarn at about 0.7 gpd tension, the bar preferably has a circumferential groove separation greater than 0.4 cm. (center to center).

DETAILED DESCRIPTION OF THE DRAWINGS

Figure 1:
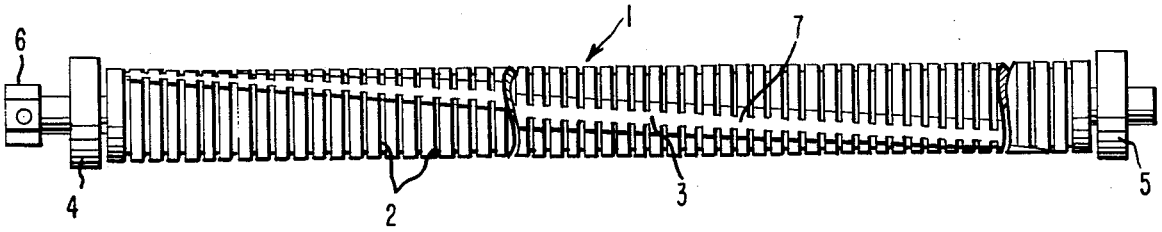
FIG. 1 shows an embodiment of the guide bar of the present invention.

In FIG. 1, cylindrical bar 1 has circumferential grooves 2 uniformly spaced along the bar. Smoothly recessed, relatively flat area 3 advances helically clockwise along the bar. The bar may be mounted in bearings 4 and 5. One end of the bar 6 is adapted to be fitted with a hand tool for rotation of the bar. The center part 7 of the flat area 3 is devoid of grooves.

Figure 2:
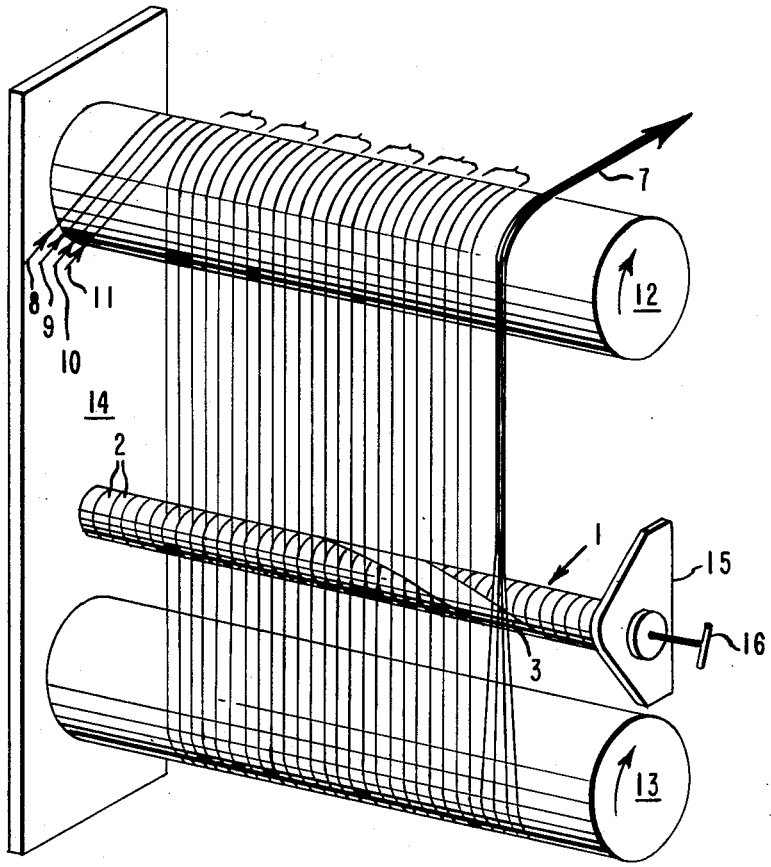
FIG. 2 shows a preferred arrangement for the guide bar for use with yarn forwarding rolls.

In FIG. 2, use of cylindrical bar 1 is shown in a system in which multiple wraps of yarn are passed over yarn forwarding rolls. In the drawings, four ends, 8, 9, 10 and 11 of uniformly spaced yarn are passed around yarn forwarding rolls 12 and 13 which are mounted on frame 14 in a canted relationship to provide for advancement of the yarns away from the frame 14. Guide bar 1 is rotatably mounted on frame 14 with its axis parallel to the axis of the following roll 12. Guide bar 1 is positioned so that yarn coming off roll 13 passes into the bottom of the grooves 2 in the bar. The outer end of bar 1 is mounted in a bracket 15 and fitted with a handle 16 for rotation of the bar. The position of the bar as shown has all but the last of seven wraps of the four yarn ends separated and engaged into the proper grooves of the bar. Further clockwise rotation of the bar 1 will separate and engage the seventh wrap. In the operating position all yarns will be engaged in grooves 2 of bar 1. The relatively flat area will be away from the yarns.

The design of the guide bar permits step-wise engagement of a multiplicity of yarns. When used in conjunction with yarn forwarding rolls, the guide bar permits engagement of the yarn wraps in sequence. Stabilization of the early wraps on the rolls by the guide bar permits easier engagement of the following wraps.

Preferably the circumferential grooves are individual, parallel grooves. While the guide bar can, in principle, have any number of grooves, instability of a multi-wrap yarn passing over forwarding rolls does not become appreciable until the yarn has traveled an appreciable distance over forwarding rolls. For 1500 denier yarn at about 0.7 gpd tension and forwarding rolls 137 cm. apart, instability becomes appreciable after about 3 wraps. Thus for this system having $x$ ends, the advantage of the invention is obtained with guide bars having at least 3 $x$ grooves.

The depth of the grooves should be sufficient to accommodate about three of the yarns to be guided and maintain separation if yarn twinning occurs. The spacing between grooves should correspond to the expected yarn spacing. In the case of yarn passing over forwarding rolls, this is determined by the incoming yarn spacing and the relative cant of the rolls with respect to each other.

The width of the relatively flat area on the guide bar and the degree of helical advance should be such as to permit engagement of the yarn one at a time. In a multi-end system having $x$ ends, $x$ adjacent yarns could remain disengaged at any one time.

EXAMPLE

A single yarn is passed 15 wraps around two vertically disposed forwarding rolls canted to provide a yarn spacing of about 4.1 cm. and jetted to waste. The spacing between the roll axes is about 137 cm. Seven additional yarns separated about 0.5 cm. apart by a comb are spliced into the first yarn one at a time and jetted to waste. In an arrangement similar to that of FIG. 2, a guide bar is rotatably mounted about 33 cm. from the point the yarn leaves the preceding roll with its axis parallel to the axis of the following roll. The guide bar is positioned so that yarn leaving the preceding roll contacts the bottom of the grooves. The relatively flat area advances helically 4° per cm. in a clockwise direction. The part of the flat area devoid of grooves is about 4.1 cm. wide. The groove width is 1.3 mm., the groove depth is 3.8 mm. and the width between grooves is 5.0 mm. The bar has 129 grooves and is 65.5 cm. long. The guide bar is rotated so as to disengage the first yarn wraps (first 8 adjacent yarns), i.e., the yarns are passing over the relatively flat area devoid of grooves. The bar is slowly rotated in the direction of helical advance (clockwise) to engage the first wrap of the eight yarns which fall separately into adjacent grooves. This automatically disengages the second wraps of the eight yarns. When the second wraps have stabilized due to engagement of the first wraps, the guide bar is further rotated to engage the second wraps and the process is repeated until all wraps are engaged. Approximately 10 seconds are required to engage all wraps when the yarns are traveling at 500 yards per minute. The rolls and guide bar are enclosed and sprayed with a treating liquid. The treated yarns are wound up separately. If desired, the yarns can be treated with liquids sequentially by similar arrangements in tandem.

What is claimed is:

1. A yarn guide comprising a rotatably mounted circumferentially grooved cylindrical bar having as part of the bar surface a smoothly recessed, relatively flat area advancing helically less than a complete turn along the length of the bar, the relatively flat area being uniformly recessed to a depth such that at least part of the recessed area is devoid of grooves.

2. The yarn guide of claim 1 rotatably mounted between two canted or skewed rolls of approximately the same length as the guide, the guide being mounted with its axis parallel to the axis of the following roll and positioned so that yarn traveling over the rolls will contact the bottom of the grooves.

3. The yarn guide of claim 1 wherein the relatively flat area advances along the length of the bar 250° to 290°.

4. The yarn guide of claim 1 wherein circumferential groove separation is greater than 0.4 cm. center to center.

* * * * *